US009044099B2

(12) United States Patent
Bouche

(10) Patent No.: US 9,044,099 B2
(45) Date of Patent: Jun. 2, 2015

(54) CHAIR WITH ADJUSTABLE TABLET

(75) Inventor: Timothy J. Bouche, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 348 days.

(21) Appl. No.: 13/450,635

(22) Filed: Apr. 19, 2012

(65) Prior Publication Data

US 2012/0267923 A1 Oct. 25, 2012

Related U.S. Application Data

(60) Provisional application No. 61/478,121, filed on Apr. 22, 2011.

(51) Int. Cl.

| | |
|---|---|
| ***A47B 39/00*** | (2006.01) |
| ***A47C 7/70*** | (2006.01) |
| ***A47C 7/68*** | (2006.01) |

(52) U.S. Cl.
CPC .... *A47C 7/70* (2013.01); *A47C 7/68* (2013.01)

(58) Field of Classification Search
USPC ..... 297/160–162, 170, 172, 344.21, 344.22
See application file for complete search history.

(56) References Cited

U.S. PATENT DOCUMENTS

| | | | | |
|---|---|---|---|---|
| 951,145 | A | 3/1910 | McGenniss | |
| 3,586,367 | A | 6/1971 | Cincotta | |
| 4,645,167 | A | 2/1987 | Hardwick | |
| 5,169,210 | A | 12/1992 | Fricano | |
| 5,683,136 | A | 11/1997 | Baumann et al. | |
| 5,816,649 | A | 10/1998 | Shields | |
| 5,893,607 | A * | 4/1999 | Trimnell | 297/170 |
| 5,931,528 | A | 8/1999 | Shields | |
| 6,352,302 | B1 | 3/2002 | Piretti, Jr. | |
| 6,375,257 | B1 | 4/2002 | Wooding et al. | |
| 6,422,646 | B1 | 7/2002 | McNally | |
| 6,669,282 | B2 | 12/2003 | Piretti | |
| 7,131,688 | B2 | 11/2006 | Steenson | |
| 7,216,930 | B2 | 5/2007 | Steenson | |
| 7,695,061 | B2 | 4/2010 | Olarte | |
| 7,726,732 | B1 | 6/2010 | Keating | |
| 7,731,277 | B2 | 6/2010 | Weber et al. | |
| 2005/0140187 | A1 | 6/2005 | Kordecki | |
| 2007/0284920 | A1 | 12/2007 | Mehaffey et al. | |
| 2008/0231091 | A1 | 9/2008 | Goranson | |

(Continued)

OTHER PUBLICATIONS

PCT Search Report dated Jun. 28, 2012.

(Continued)

*Primary Examiner* — Philip Gabler
*Assistant Examiner* — Alexander Harrison
(74) *Attorney, Agent, or Firm* — Andrus Intellectual Property Law, LLP

(57) ABSTRACT

A chair including a writing tablet that can be used with both a right handed and a left handed seat occupant. The chair includes a writing tablet that is supported on a tablet arm. The tablet arm is pivotable beneath the seating element of the chair such that the tablet arm can be positioned on either the right side or left side of the user. The writing tablet is pivotally mounted to the tablet arm such that the writing tablet can pivot toward and away from the seat occupant. The writing tablet is further movably mounted to the tablet arm such that the writing tablet can move toward and away from the seat occupant. The seating element of the chair is pivotably mounted to a support structure including chair legs and preferably caster wheels.

15 Claims, 11 Drawing Sheets

(56) References Cited

U.S. PATENT DOCUMENTS

| | | | | |
|---|---|---|---|---|
| 2011/0187164 | A1* | 8/2011 | Corcorran et al. | 297/170 |
| 2014/0097650 | A1* | 4/2014 | Corcorran et al. | 297/160 |

OTHER PUBLICATIONS

PCT Preliminary Report on Patentability dated Oct. 31, 2013.
Canadian Patent Office Action dated Jan. 10, 2014.
Office Action dated Jan. 10, 2014 issued against Canadian Patent Application No. 2,800,937.
Office Action dated Jul. 28, 2014 issued against Canadian Patent Application No. 2,800,937.

* cited by examiner

CHAIR WITH ADJUSTABLE TABLET

CROSS-REFERENCE TO RELATED APPLICATION

The present application is based on and claims priority to U.S. Provisional Patent Application Ser. No. 61/478,121 filed Apr. 22, 2011.

BACKGROUND OF THE INVENTION

The present disclosure relates to a chair with a writing tablet. More specifically, the present disclosure relates to a chair with a writing tablet that can be moved to either side of a seating element and can be moved longitudinally toward and away from the seat occupant and rotated toward and away from the seat occupant.

Tablet arm chairs are often used in different seating applications in which the seat occupant needs a writing tablet to support documents or a computer. Since left handed and right handed occupants require the tablet to be positioned on opposite sides of the chair, many seating arrangements have been developed in which the writing tablet is fixed on either the right or left side of the seat occupant. This type of arrangement requires a facility to have an adequate number of chairs for both right-handed and left-handed occupants, which is often difficult to estimate and results in an excess of left-handed seats being stored and unused.

Additionally, it is desirable for the writing tablet to be movable relative to the seat occupant once the tablet is on the correct side of the occupant. Typically, this movement is either a pivotable motion of the tablet to allow the occupant easier ingress and egress or longitudinal movement toward the occupant to adjust for various sized occupants.

SUMMARY OF THE INVENTION

The present disclosure relates to a chair with a writing tablet that can be configured for use by either a right-handed or a left-handed seat occupant. The tablet chair of the present disclosure includes a writing tablet that is supported by a tablet arm. The tablet arm extends beneath the seat of a seating element. The tablet arm is pivotally mounted to a chair support structure such that the entire tablet arm can move at least 180° from a right side of the chair to a left side of the chair. More preferably, the tablet arm is movable over greater than 180° relative to the chair support structure.

The tablet arm supports a writing tablet through a pivoting connection between the tablet arm and the writing tablet. The pivoting connection between the tablet arm and the writing tablet allows the writing tablet to move toward and away from the seat occupant when the seat occupant is positioned in the seating element.

The writing tablet is mounted to the tablet support arm through a mounting structure. The mounting structure includes a pair of slide rails that allow the writing tablet to move relative to the support structure when the support structure is stationary. In this manner, the writing tablet can move toward and away from the seat occupant when the seat occupant is positioned in the seating element.

The seating element is rotatably mounted to a support structure that includes four legs and caster wheels. The seating element is able to pivot relative to the chair legs such that the occupant can rotate the seating element to enter and leave the seated position.

As described above, the chair of the present disclosure includes four separate and independent degrees of movement that allows the chair to accommodate seat occupants of different sizes and different writing hands. The chair of the present disclosure can thus be tailored for use with each individual seat occupant, which increases the flexibility of the chair design.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION OF THE DRAWINGS

Figure 1:
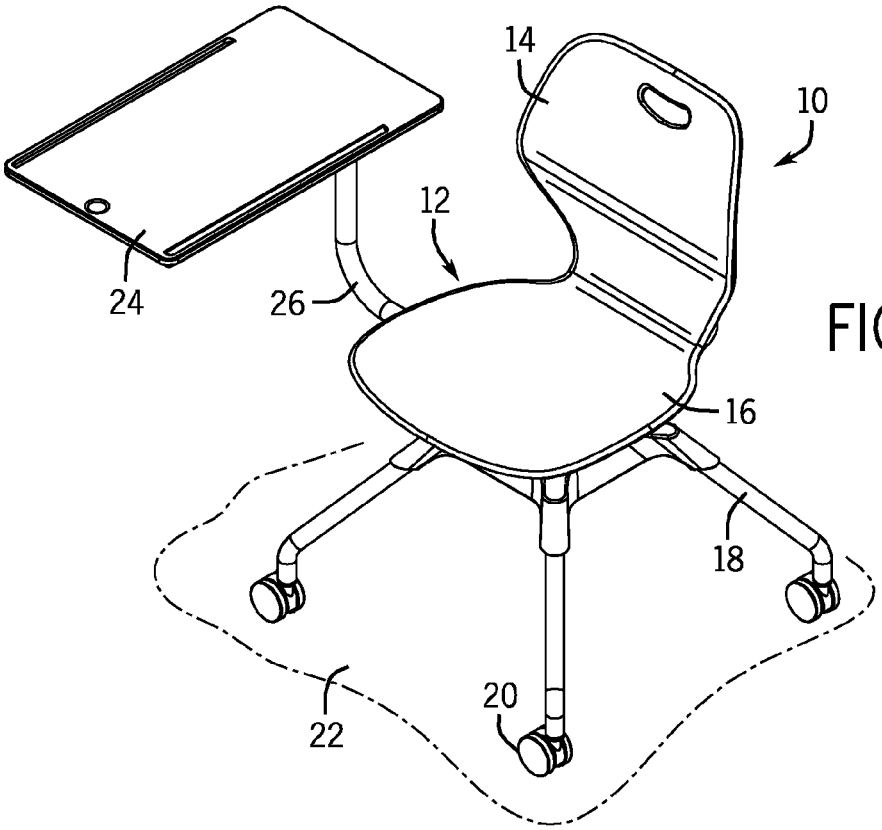
FIGS. 1 and 1A are opposite side isometric views of a chair with a writing tablet positioned to the right and left of the seat occupant.
Figure 1A:
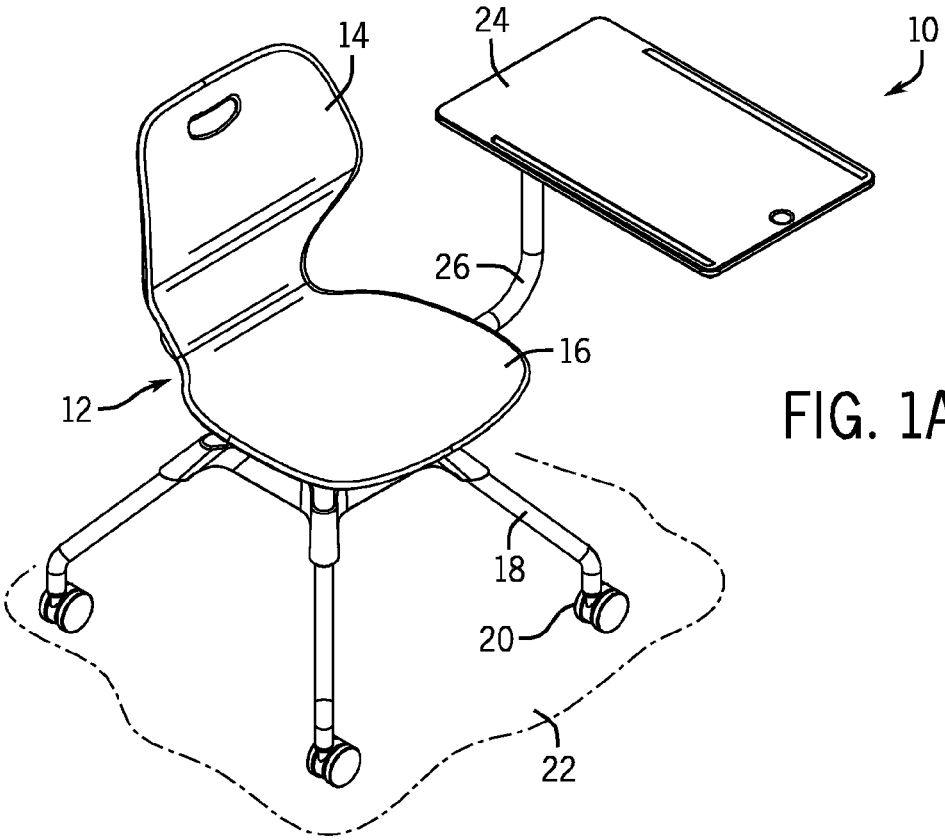

FIGS. 1 and 1A illustrate a chair 10 constructed in accordance with the present disclosure. The chair 10 includes a seating element 12 having a chair back 14 and a seat 16. In the embodiment shown in FIG. 1, the chair back 14 and seat 16 are shown as an integrally molded component. However, it should be understood that the seating element 12 could take other configurations while operating within the scope of the present disclosure, including embodiments having a separate chair back 14 and seat 16.

The seating element 12 is supported in an axial direction X by four legs 18 each of which includes a caster wheel 20. The caster wheels 20 allow the chair 10 to be easily moved along a floor 22. Although caster wheels 20 are shown, it is contemplated that the wheels could be eliminated or replaced with other structure while maintaining operation within the scope of the present disclosure.

The chair 10 of the present disclosure includes an adjustable writing tablet 24 that is supported relative to the seating element 12 by a tablet arm 26. As will be described in much greater detail below, the tablet arm 26 is pivotally mounted beneath the seat 16 and rotatable about a generally vertical pivot axis such that the writing tablet 24 can be moved from the right-hand position shown in FIG. 1 to the left-hand position shown in FIG. 1A. In this manner, the chair 10 of the present disclosure can be used by an occupant who is either right-handed or left-handed such that different chairs are not required for the two different types of occupants.

Figure 2:
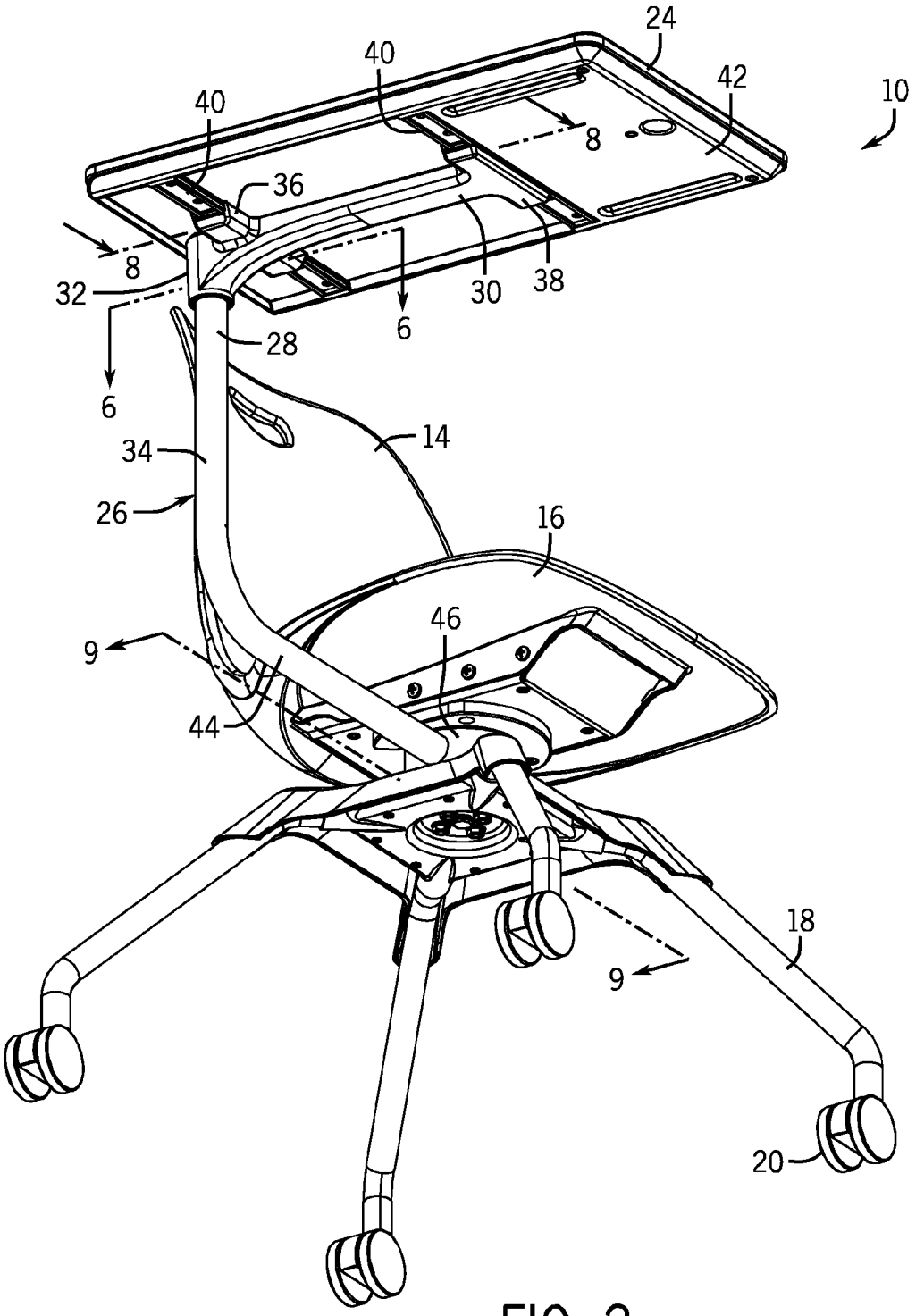
FIG. 2 is a bottom isometric view illustrating the underside of the chair and writing tablet.

FIG. 2 illustrates a bottom view of the chair 10 of the present disclosure. As illustrated in FIG. 2, the tablet arm 26 includes an upper end 28 that is received within a tablet support bracket 30. The tablet support bracket 30 includes a tubular sleeve 32 that allows the entire tablet support bracket 30, and thus the entire writing tablet 24, to pivot about a second, generally vertical pivot axis extending through a vertical portion 34 of the tablet arm 26. The tablet support bracket 30 includes a pair of spaced slide arms 36, 38 that each receive one of a pair of spaced rails 40 mounted to the bottom surface 42 of the writing tablet 24. The interaction between the slide arms 36, 38 and the slide rails 40 allow the writing tablet 24 to move laterally toward and away from the seat occupant, as shown by arrows 41 in FIGS. 5C and 5D and as will also be discussed in greater detail below.

Referring back to FIG. 2, a horizontal portion 44 of the tablet arm 26 extends beneath the seat 16 and is joined to an outer shroud 46. The outer shroud 46, and thus the attached tablet arm 26, is rotatable beneath the seat 16 such that the entire tablet arm 26 can be moved from the right position shown in FIG. 1 to the left position shown in FIG. 1A. The pivoting movement of the tablet arm 26 is shown by arrows 47 in FIGS. 5E and 5F and will be described in much greater detail below.

Figure 3:
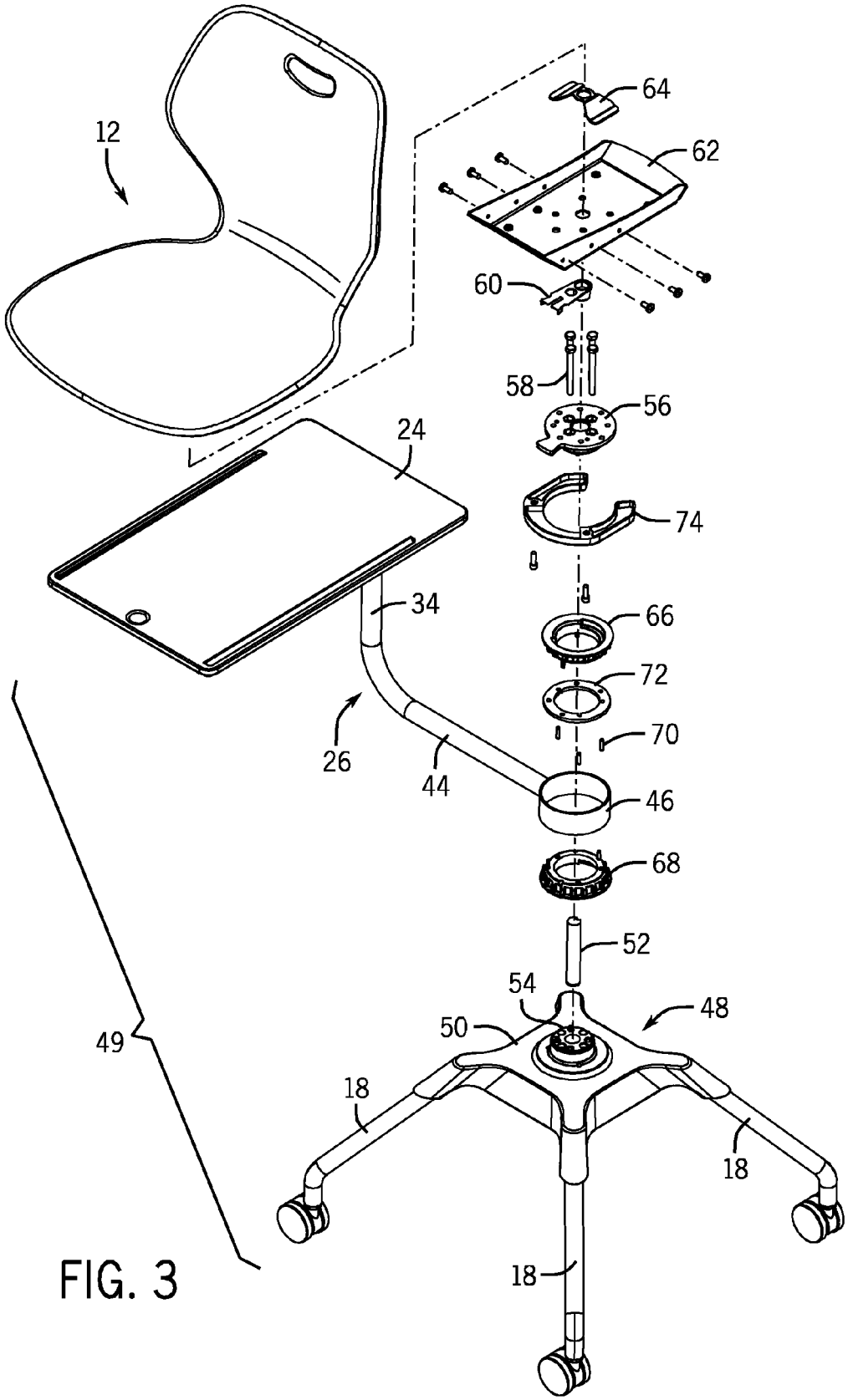
FIG. 3 is an exploded isometric view of the mounting arrangement for the seating element of the present disclosure.

FIG. 3 is an exploded view of a mounting arrangement 49 between the seating element 12, the tablet arm 26, and the chair support structure 48, which includes the four chair legs 18 and a leg weldment 50. The mounting arrangement 49 includes a stationary mounting post 52 that is secured to the leg weldment 50. The mounting post 52 extends through a lower bearing casting 54 and an upper bearing casting 56. The upper and lower bearing castings 54, 56 are secured to each other by a series of connectors 58.

The mounting post 52 extends through an upper bushing 60 and into a seat mounting plate 62. A weldment 64 surrounds the upper end of the mounting post 52 to prevent movement of the mounting post 52 relative to the mounting plate 62.

The mounting arrangement 49 includes an upper bearing 66 and a lower bearing 68 that are joined to each other through connecting pins 70 that each extend through a bearing plate 72. The shroud 46 encloses the combination of the upper and lower bearings 66, 68 and is joined to the bearing plate 72, which allows the tablet arm 26 to pivot relative to the upper and lower bearing castings 56, 54, respectively. A pivot limiting plate 74 is mounted to the underside of the seat mounting plate 62 to limit the rotation of the seating element 12 relative to the chair support structure 48.

Figure 4:
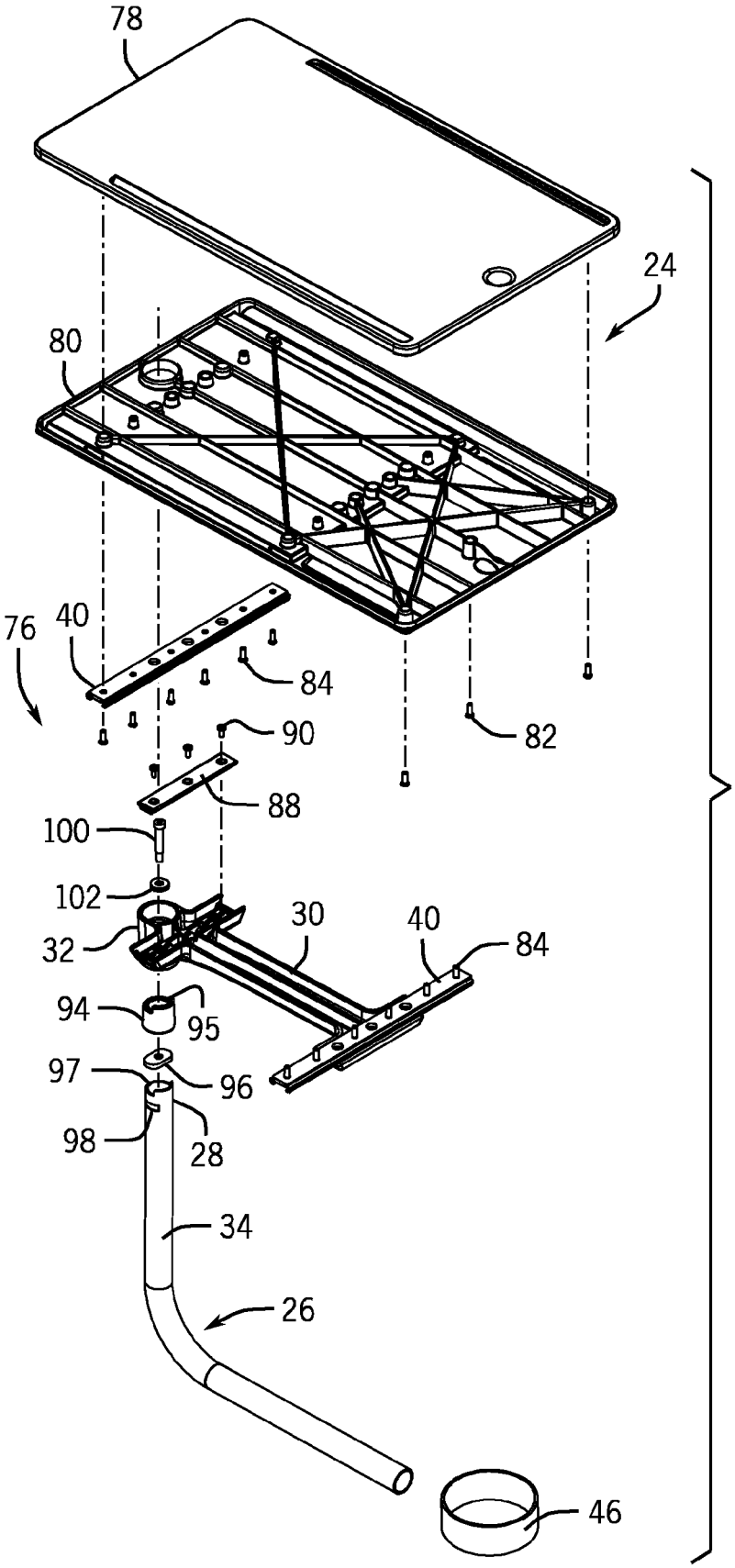
FIG. 4 is an exploded isometric view of the mounting arrangement for the writing tablet.

FIG. 4 is an exploded view of the mounting arrangement 76 for mounting the writing tablet 24 to the tablet arm 26. In the embodiment shown in FIG. 4, the writing tablet is formed from a molded upper half 78 and a lower half 80 that are joined to each other by a series of connectors 82. As described previously, the lower half 80 of the writing tablet 24 receives a pair of spaced rails 40 mounted to the lower half 80 through a series of connectors 84.

Figure 8:
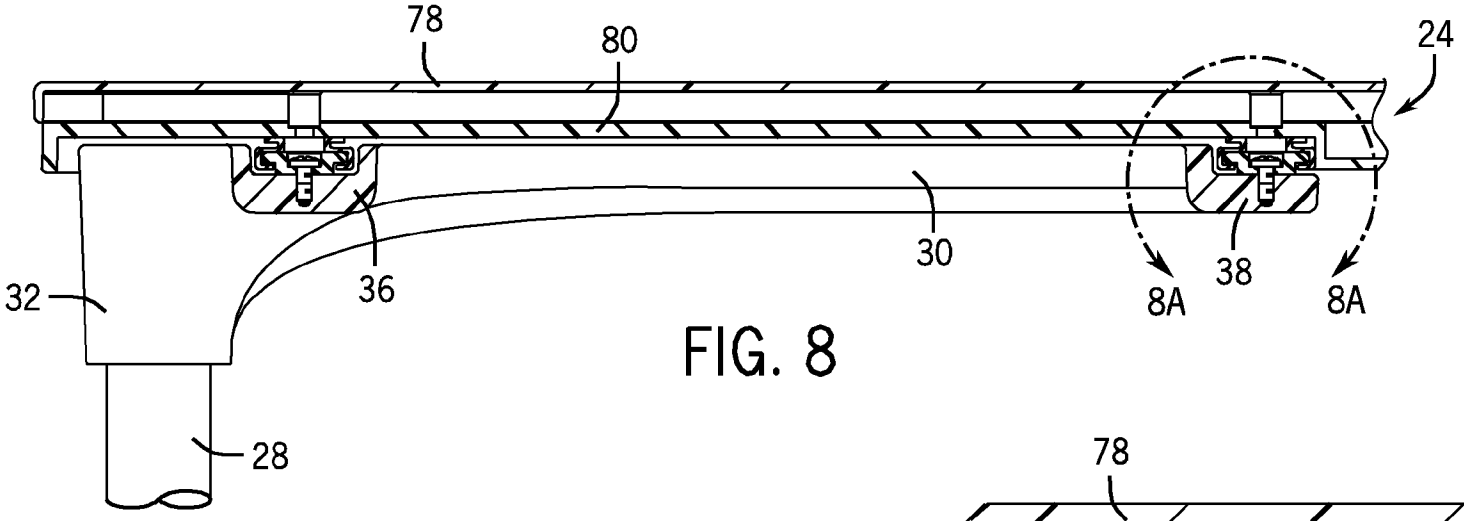
FIG. 8 is a section view taken along line 8-8 of FIG. 2.
Figure 8A:
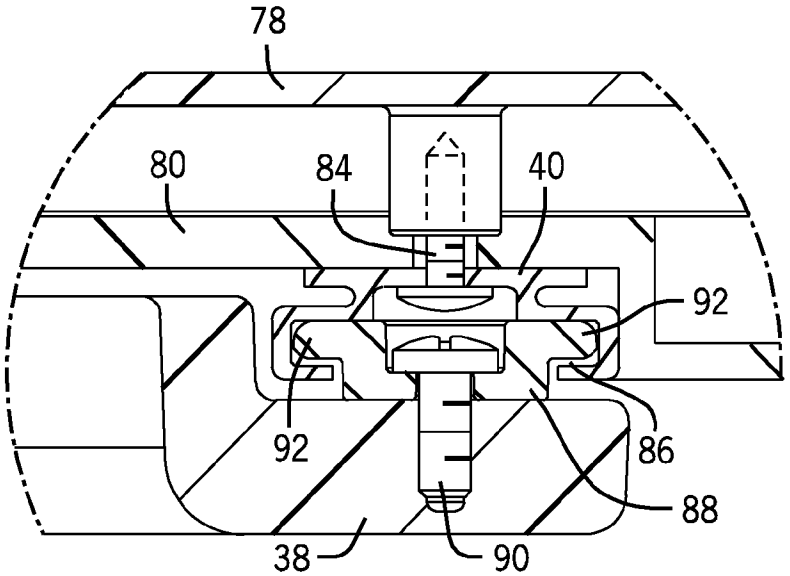
FIG. 8A is a magnified view of the area shown by line 8A-8A of FIG. 8.

Referring now to FIGS. 8 and 8A, each of the rails 40 has an open channel 86 that receives a slide member 88 that is connected to the slide arm 38 through another series of connectors 90. As shown in FIG. 8A, the slide member 88 includes a pair of projecting flanges 92. The interaction between the slide member 88 and the rail 40 allows the writing tablet 24 to move relative to the tablet support 30.

Referring back to FIG. 4, the tablet mounting arrangement 76 includes a pivot limiting sleeve 94 that is received on the upper end 28 of the vertical portion 34 of the tablet arm 26. The pivot limiting sleeve 94 includes an extending flange 95 that corresponds to a similar flange portion 97 formed on the upper end 28 of the tablet arm 26. As can be seen in FIG. 4, the flange portions 95, 97 extend over less than half of the outer circumference of the pivot limiting sleeve 94 and the vertical portion 34 of the tablet arm 26, respectively. A mounting plate 96 extends through a slot 98 and is securely held within the upper end 28. A connector 100 extends through a washer 102 and is received within a threaded opening within the mounting plate 96 to hold the tablet support 30 in place while allowing for pivoting movement of the tablet support 30 relative to the tablet arm 26.

Figure 6:
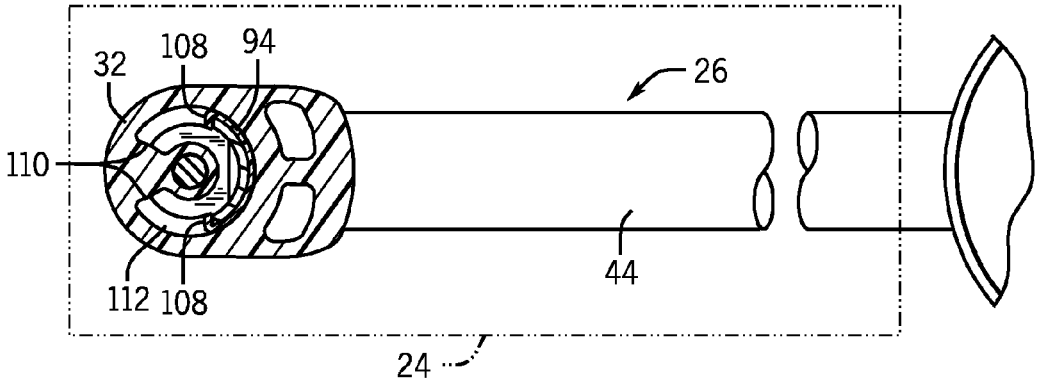
FIG. 6 is a section view taken along line 6-6 of FIG. 2.
Figure 7:
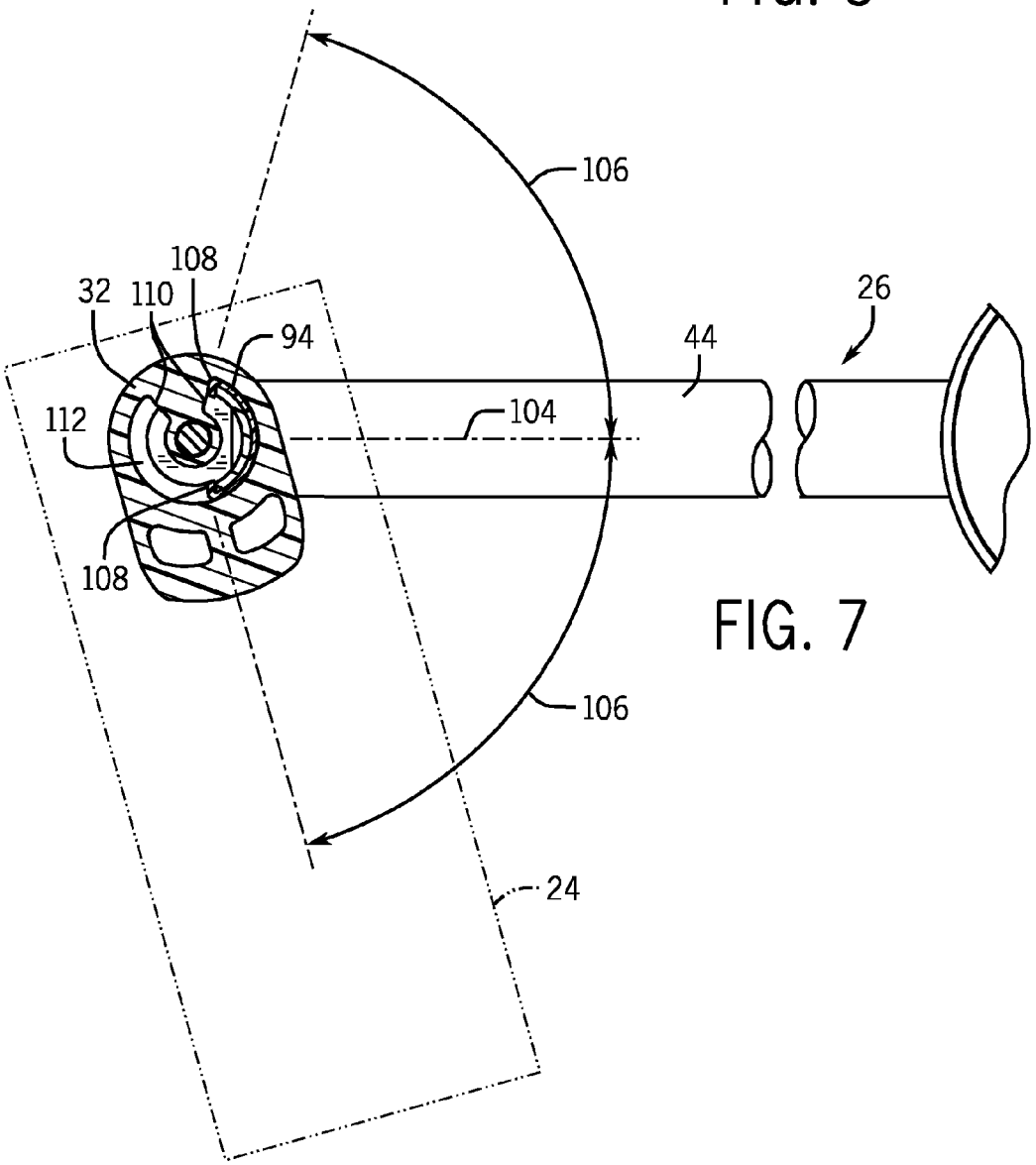
FIG. 7 is a view similar to FIG. 6 showing the pivoting movement of the support structure.

Referring now to FIGS. 6 and 7, the writing tablet 24 is shown in phantom. The writing tablet 24 is pivotable about the tablet arm 26 relative to a centerline 104 that extends through the horizontal portion 44. As illustrated in FIG. 7, the writing tablet 24 is pivotable approximately 75° from the centerline 104 in each direction, as illustrated by arrows 106 in FIG. 7. Thus, the writing tablet 24 is prevented from pivoting more than a predetermined amount relative to the tablet arm 26. In this example, the predetermined amount is 150° (75°+75°). The pivoting movement of the writing tablet 24 is controlled by the interaction between outer ends 108 of the flange 95 on the pivot limiting sleeve 94 and ends 110 of a pivot channel 112 formed in the tubular sleeve 32. In this manner, the pivoting movement of the writing tablet 24 is controlled and defined.

Figure 9:
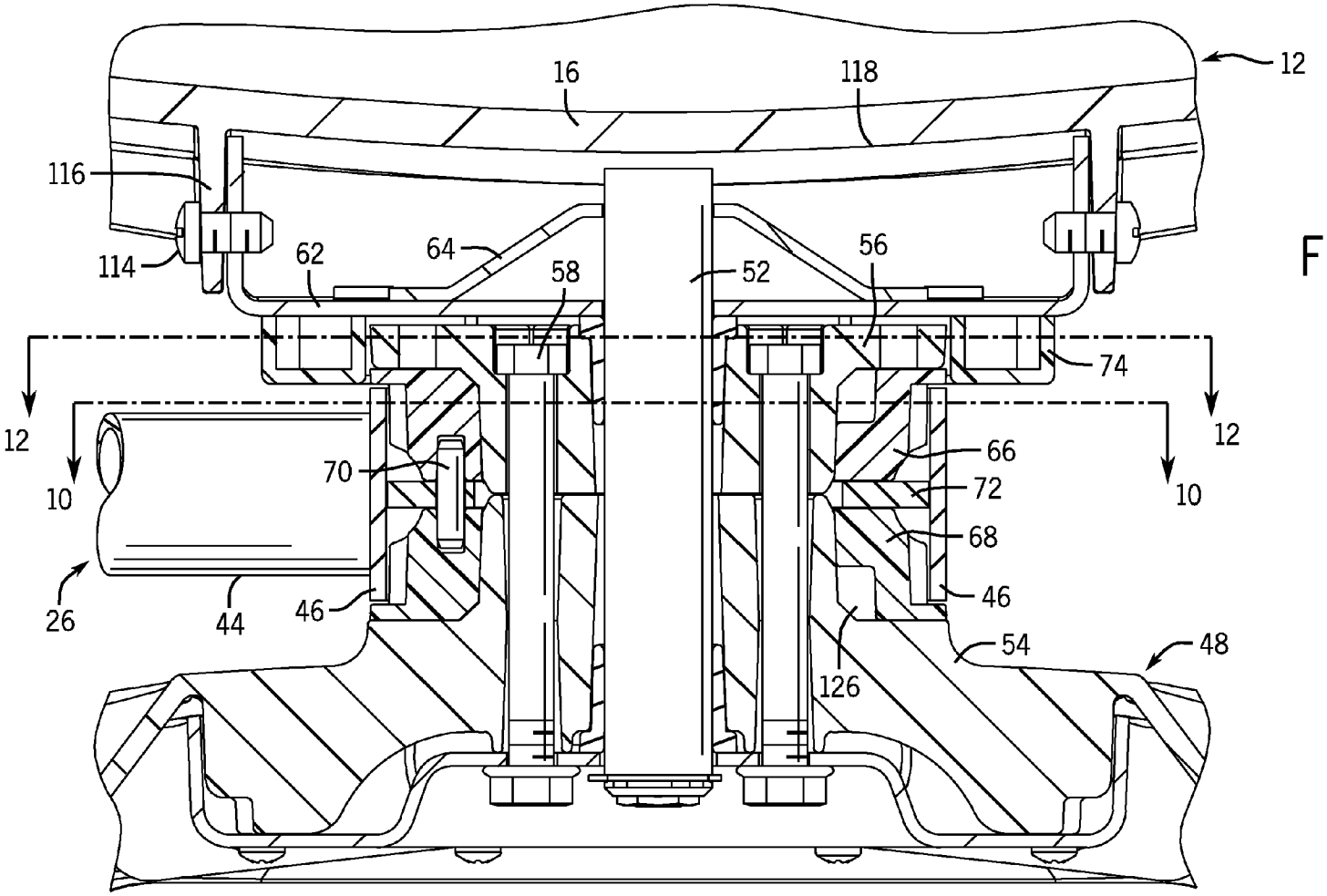
FIG. 9 is a section view taken along line 9-9 of FIG. 2.

FIG. 9 illustrates the mounting arrangement between the seating element 12 and the chair support structure 48. As described previously, the mounting arrangement shown in FIG. 9 allows the seating element 12 to pivot about the generally vertical pivot axis relative to the chair support structure 48 while also allowing the tablet arm 26 to rotate underneath the seat 16. As described previously, the mounting post 52 extends into the seat mounting plate 62 and receives a weldment 64. The seat mounting plate 62 is connected to the seat 16 by a series of connectors 114 that each pass through flanges 116 extending from the lower surface 118 of the seat 16. The pivot limiting plate 74 is secured to the seat mounting plate 62. The lower bearing casting 54 and the upper bearing casting 56 are joined to each other by the series of connectors 58. The upper and lower bearing castings 54, 56 entrap the lower bearing 68 and the upper bearing 66. The bearing plate 72 is positioned between the two bearings and is held in place by the pins 70.

Figure 10:
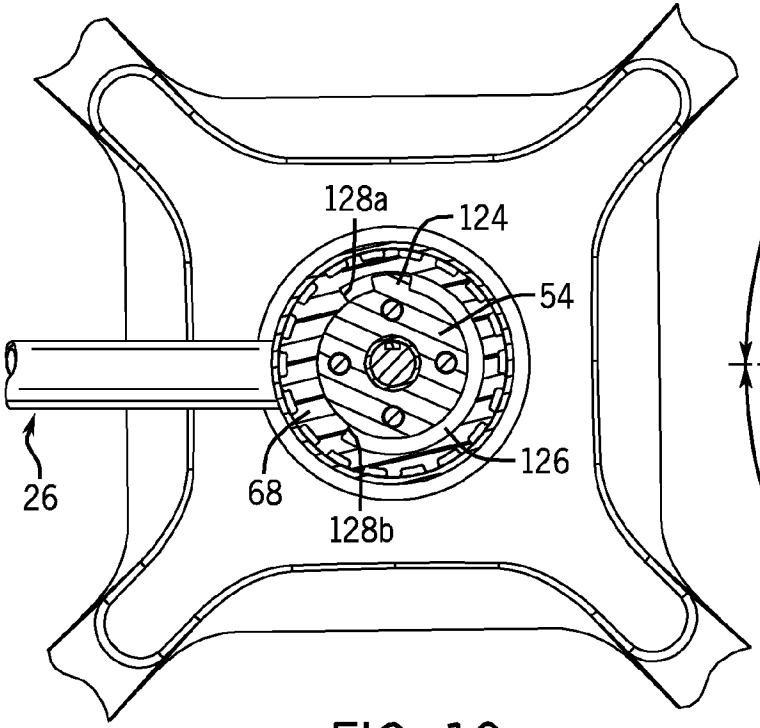
FIG. 10 is a section view taken along line 10-10 of FIG. 9.

The horizontal portion 44 of the tablet arm 26 is secured to the shroud 46. The shroud 46 is attached to the bearing plate 72 such that the bearing plate 72 and the upper and lower bearings 66, 68 rotate with the tablet arm 26 in a manner to be described below. Referring now to FIG. 10, the lower bearing casting 54 includes a key 124. The lower bearing casting 54 is stationary such that the key 124 remains in the position shown in FIG. 10. The key 124 is received within a channel 126 located in the lower bearing 68 and defined by a pair of stop shoulders 128*a* and 128*b*. The stop shoulders 128*a* and 128*b* limit the pivoting movement of the tablet arm 26 as shown in FIG. 11.

Figure 11:
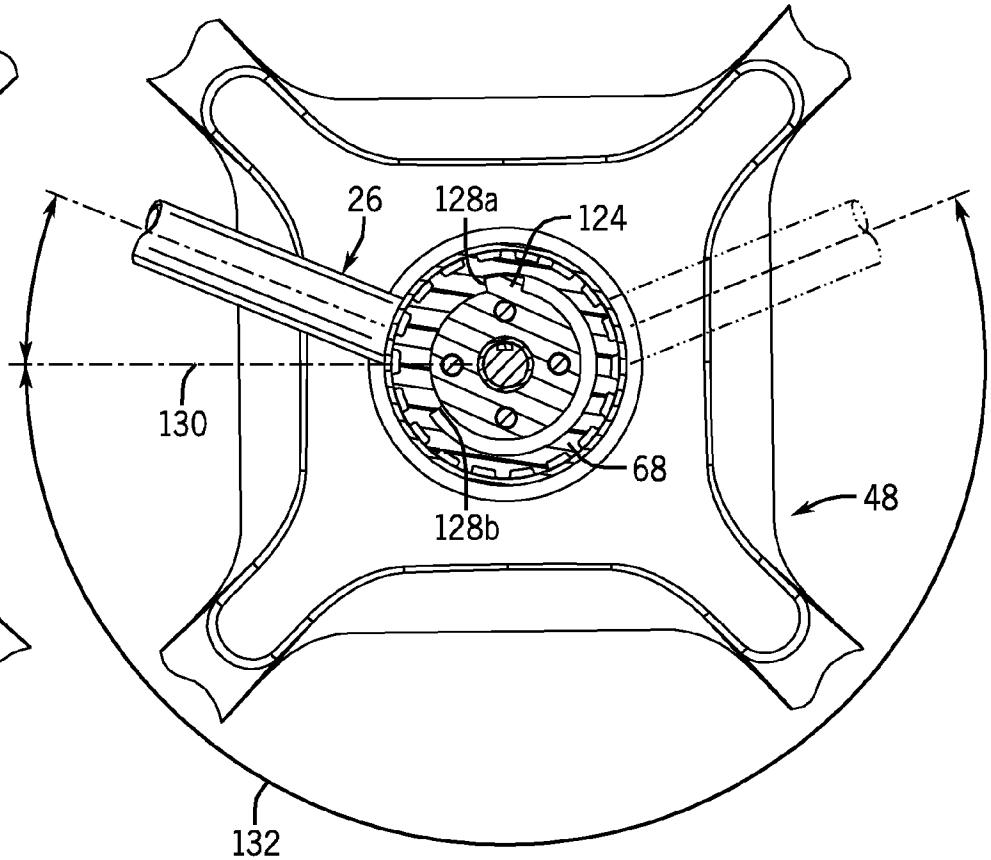
FIG. 11 is a view similar to FIG. 10 showing the pivoting movement of the support arm.

As illustrated in phantom in FIG. 11, the tablet arm 26 assumes its leftmost rotational position when the key 124 engages the stop shoulder 128*a*. In this position, the tablet arm 26 is rotated approximately 35° from the centerline 130. In this position, the tablet arm assumes its furthest rotation for a right handed user.

As illustrated in FIG. 11, the tablet arm can assume its leftmost position by rotating the tablet arm until the key 124 engages the opposite stop shoulder 128*b*. As can be understood by arrow 132, the tablet arm 26 can rotate approximately 250°-270° relative to the stationary chair support structure 48. Thus, the tablet arm can be rotated for use by both a right handed user and a left handed user, as previously described. Thus, the tablet arm 26 is prevented from rotating more than a predetermined amount around the generally vertical pivot axis. In this example, the predetermined amount is 285°-305° (250°+35° to 270°+35°).

Figure 13:
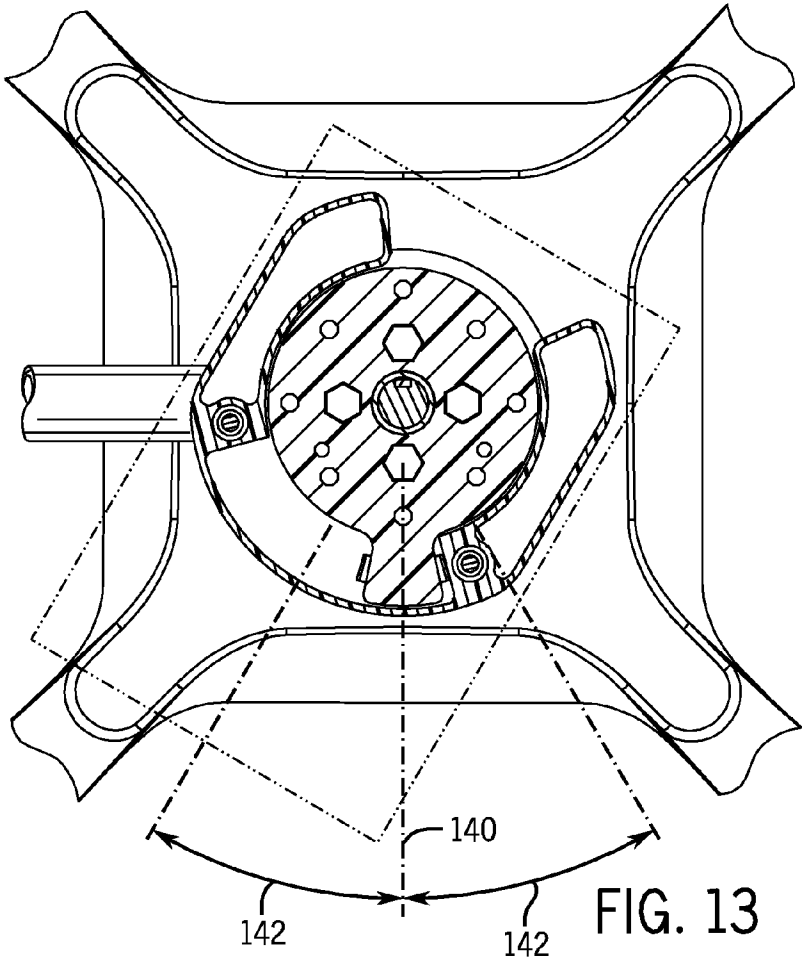
FIG. 13 is a section view similar to FIG. 12 showing the pivoting movement of the seat.
Figure 12:
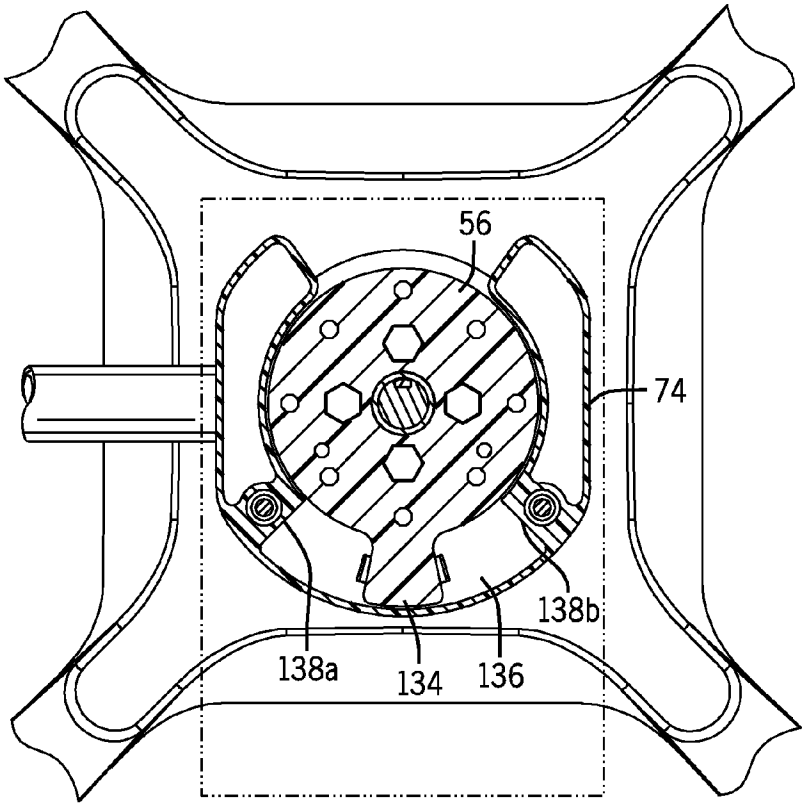
FIG. 12 is a section view taken along line 12-12 of FIG. 9.

Referring now to FIG. 12, the upper bearing casting 56 includes a key 134 that moves within an open channel 136 formed as part of the pivot limiting plate 74. The channel 136 is defined by a pair of stop shoulders 138*a* and 138*b* that are used to define the pivoting rotation of the seating element. As illustrated in FIG. 13, the seating element can rotate approximately 35° from a centerline 140, as illustrated by arrows 142.

Figure 5A:
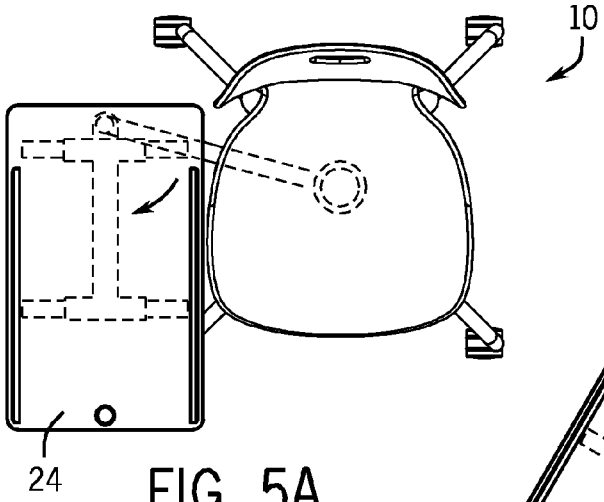
FIGS. 5A-5B illustrate the pivoting movement of the writing tablet.
Figure 5B:
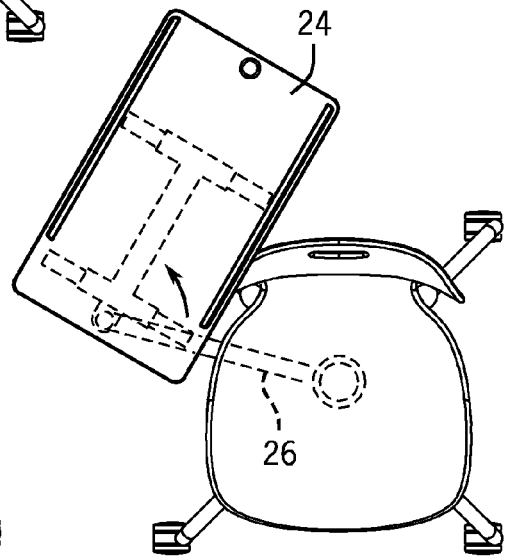

The various pivoting movements of the chair 10 of the present disclosure are generally shown in FIGS. 5A-5H. FIGS. 5A-5B illustrate the pivoting movement of the writing tablet 24 relative to the tablet arm 26 when the tablet arm is stationary.

Figure 5C:
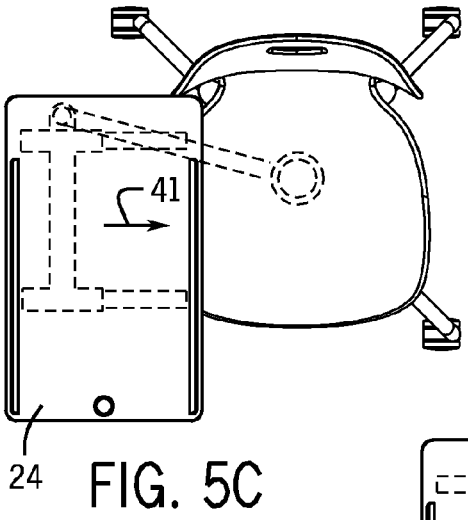
FIGS. 5C-5D illustrate the longitudinal movement of the writing tablet along the support structure.
Figure 5D:
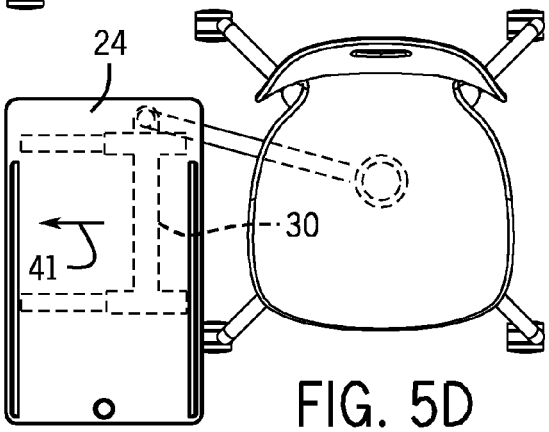

FIGS. 5C-5D illustrate the longitudinal movement of the writing tablet relative to the stationary tablet support 30.

Figure 5E:
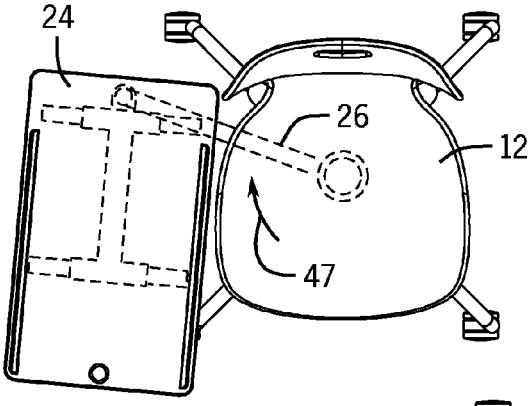
FIGS. 5E-5F illustrate the pivoting movement of the entire writing tablet support arm about the chair.
Figure 5F:
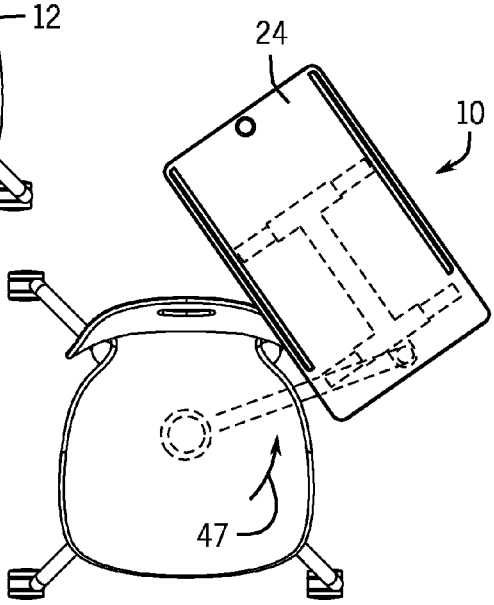

FIGS. 5E-5F illustrate the rotational movement of the tablet arm 26 relative to the stationary seating element 12. In this manner, the tablet 24 can be used with both a right handed occupant and a left handed occupant without having to reconfigure the chair 10.

Figure 5G:
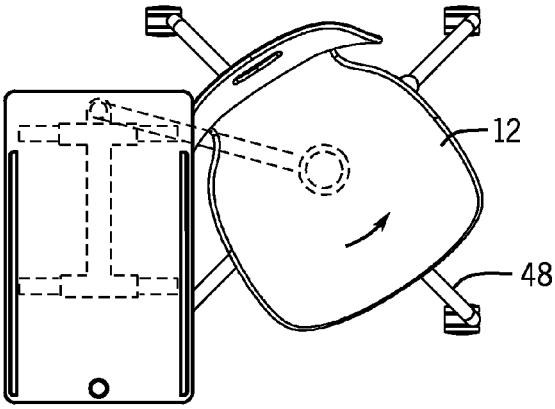
FIGS. 5G-5H illustrate the pivoting movement of the seating element relative to the support structure.
Figure 5H:
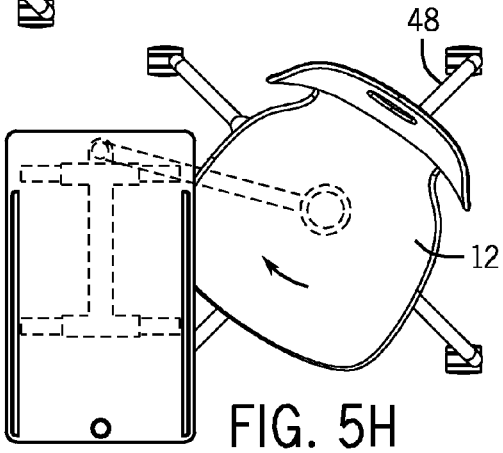

Finally, FIGS. 5G-5H illustrate the pivoting movement of the seating element 12 relative to the stationary chair support structure 48.

As can be understood in FIGS. 5A-5H, the chair 10 of the present disclosure includes four separate and distinct movements that allow the chair to be utilized with various seat occupants and for various different purposes. The movements shown in the Figures do not require any mechanical adjustments to the chair and can be performed by the seat occupant.

Although not shown in the drawing Figures, it is contemplated that various different storage racks or baskets could be mounted beneath the seating element and supported by the four legs 18 shown in FIG. 3. Different types of baskets and storage racks are contemplated and would allow an occupant to store materials beneath the seat. Such a basket would be movable along with the chair 10 of the present disclosure and allow the occupant to place materials beneath the seat which would travel with the user when the chair is rolled along the support surface.

Thus, the present disclosure describes a chair 10 with a writing tablet 24 that can be configured for use by either a right-handed or left-handed occupant, the chair 10 comprising: a seating element 12 supported in an axial direction by a chair support structure 48; a tablet arm 26 extending laterally from the chair support structure 48 and supporting the writing tablet 24; wherein the tablet arm 26 is pivotally coupled to the chair support structure 12 such that the tablet arm 26 can pivot around a generally vertical pivot axis from a right side of the chair 10 to a left side of the chair 10; and wherein the writing tablet 24 is pivotally coupled to the tablet arm 26 such that the writing tablet 24 can pivot toward and away from the occupant. In one example, the chair 10 can further comprise a mounting arrangement 49 coupled to the chair support structure 48, the mounting arrangement 49 having one or more pivotable bearings 66, 68 that allow the tablet arm 26 to pivot around a generally vertical pivot axis.

The mounting arrangement 49 can further comprise a pivotable upper bearing 66 and a pivotable lower bearing 68; a bearing plate 72 interposed between and coupled to the upper 66 and lower 68 bearings; an outer shroud 46 coupled to the bearing plate 72 and encircling the upper 66 and lower 68 bearings and the bearing plate 72; and a mounting post 52 secured at a lower end to the chair support structure 48 and extending upwardly in the axial direction through apertures in the upper 66 and lower 68 bearings and the bearing plate 72; wherein a lower end of the tablet arm 26 is coupled to the shroud 46 such that it pivots with the bearing plate 72 and the upper 66 and lower 68 bearings around the mounting post 52. The mounting arrangement may further comprise a lower bearing casting 54 coupled to the chair support structure 48 and surrounding the lower end of the mounting post 52.

The mounting arrangement 49 can prevent the tablet arm 26 from pivoting more than a predetermined amount relative to a generally vertical pivot axis. This can be done by contact between the lower bearing casting 54 and the lower bearing 68. The contact between the lower bearing casting 54 and the lower bearing 68 can be provided by a key 124 formed on the lower bearing casting 54 that is received within a pivot limiting channel 126 formed in the lower bearing 68. The lower bearing 68 can pivot while the lower bearing casting 54 remains stationary, such that the pivot limiting channel 126 moves about the key 124 until one of two ends 128*a*, 128*b* of the pivot limiting channel 126 contacts the key 124.

The mounting arrangement 49 can further comprise an upper bearing casting 56 coupled to the lower bearing casting 54 and surrounding an upper end of the mounting post 52, wherein the upper bearing casting 56 enables pivoting of the seating element 12 around the same pivot axis as defining the pivoting of the tablet arm 26. Each of the tablet arm 26 and the seating element 12 can rotate independently of the other around the common pivot axis.

In a further example, the writing tablet 24 can be pivotally coupled to the tablet arm 26 by a tablet mounting arrangement 76 that prevents the writing tablet 24 from pivoting more than a predetermined amount relative to the tablet arm 26. The chair 10 may further comprise a semi-cylindrical pivot channel 112 formed in the tablet mounting arrangement 76 that receives a pivot limiting sleeve 94 on an upper end of the tablet arm 26. The pivot limiting sleeve 94 may comprise a semi-cylindrical flange 95 having outer ends 108 and the writing tablet 24 may be prevented from pivoting more than the predetermined amount by engagement of the outer ends 108 of the flange 95 with ends 110 of the pivot channel 112.

In a further example, the chair 10 may further comprise a tablet mounting arrangement 76 coupling the writing tablet 24 to an upper end of the tablet arm 26, wherein the tablet mounting arrangement 76 allows the writing tablet 24 to slide laterally with respect to the tablet arm 26. The tablet mounting arrangement 76 may comprise one or more rails 40 coupled to an underside of the writing tablet 24 and a tablet support bracket 30 coupled to the upper end of the tablet arm 24, wherein the tablet support bracket 30 is slidably engaged with the one or more rails 40.

What is claimed is:

1. A chair with a writing tablet that can be configured for use by either a right-handed or left-handed occupant, the chair comprising:

a seating element supported by a chair support structure;

a tablet arm extending laterally from the chair support structure and supporting, the writing tablet;

a mounting arrangement coupled to the chair support structure, the mounting arrangement having one or more pivotable bearings that allow the tablet arm to pivot relative to the chair support structure;

a pivotable upper bearing and a pivotable lower bearing;

a bearing plate interposed between and coupled to the upper and lower bearings;

an outer shroud coupled to the bearing plate and encircling the upper and lower bearings and the bearing plate; and a mounting post secured at a lower end to the chair support structure and extending upwardly in the axial direction through apertures in the upper and lower bearings and the bearing plate;

wherein the tablet mounting arrangement allows the writing tablet to slide transversely lateral with respect to the tablet arm;

wherein the tablet arm is pivotally coupled to the chair support structure such that the tablet arm can pivot about a first pivot axis from a right side of the chair to a left side of the chair; and wherein the writing tablet is pivotally coupled to the tablet arm such that the writing tablet can pivot about a second pivot axis toward and away from the occupant when the occupant is seated in the chair; and wherein a lower end of the tablet arm is coupled to the shroud such that the tablet arm pivots with the bearing plate and the upper and lower bearings around the mounting post.

2. The chair of claim 1 wherein the mounting arrangement prevents the tablet arm from pivoting more than as predetermined amount around the first pivot axis extending through the chair support structure.

3. The chair of claim 2 wherein the predetermined amount is 305 degrees.

4. The chair of claim 2 wherein the mounting arrangement further comprises a lower bearing casting coupled to the chair support structure and surrounding the lower end of the mounting post.

5. The chair of claim 4 wherein the tablet arm is prevented from pivoting more than the predetermined amount by contact between the lower bearing casting and the lower bearing.

6. The chair of claim 5 wherein the contact between the lower bearing casting and the lower bearing is provided by a key formed on the lower bearing casting that is received within a pivot limiting channel formed in the lower bearing.

7. The chair of claim 6 wherein the lower bearing pivots while the lower bearing casting remains stationary, such that the pivot limiting channel moves about the key until one of two ends of the pivot limiting channel contacts the key.

8. The chair of claim 4 further comprising an upper bearing casting coupled to the lower bearing casting and surrounding an upper end of the mounting post, wherein the upper bearing, casting enables pivoting of the seating element around the first pivot axis.

9. The chair of claim 8 wherein each of the tablet arm and the seating element rotates independently of the other about the first pivot axis.

10. The chair of claim 1 wherein the tablet mounting arrangement comprises one or more rails coupled to an underside of the writing tablet and a tablet support bracket coupled to the upper end of the tablet arm, wherein the tablet support bracket is slidably engaged with the one or more rails.

11. A chair with a writing tablet that can be configured for use by either a right-handed or left-handed occupant the chair comprising:

a seating element supported by a chair support structure;

a tablet arm extending laterally from the chair support structure; and a tablet mounting arrangement coupling the writing tablet to an upper end of the tablet arm;

wherein the tablet arm is pivotally coupled to the chair support structure such that the tablet arm can pivot about a first pivot axis from a right side of the chair to a left side of the chair;

wherein the tablet mounting arrangement is pivotally coupled to the tablet arm such that the writing tablet can pivot about it second pivot axis toward and away from the occupant when the occupant is seated in the chair;

wherein the tablet mounting arrangement allows the writing tablet to slide laterally with respect to the tablet arm in a direction tangential to the second pivot axis;

wherein the tablet mounting arrangement prevents the writing tablet from pivoting more than formed in the tablet mounting arrangement that receives a pivot limiting sleeve on an upper end of the tablet arm the pivot limiting sleeve comprising a semi-cylindrical flange having outer ends and wherein the writing tablet is prevented from pivoting more than the predetermined amount by engagement of the outer ends of the flange with ends of the pivot channel.

12. The chair of claim 11 wherein the predetermined amount is 150 degrees.

13. A chair with a writing tablet that can be configured for use by either a right-handed or left-handed occupant, the chair comprising:

a seating element supported by a chair support structure; and a tablet arm extending laterally from the chair support structure and supporting the writing tablet;

a mounting arrangement coupled to the chair support structure, the mounting arrangement comprising:

a pivotable upper bearing and a pivotable lower bearing;

a bearing plate interposed between and coupled to the upper and lower bearings;

an outer shroud coupled to the bearing plate and encircling the upper and lower bearings and the bearing plate; and a mounting post secured at a lower end to the chair support structure and extending upwardly in the axial direction through apertures in the upper and lower bearings and the bearing plate;

wherein the lower end of the tablet arm is coupled to the shroud such that the tablet arm pivots with the bearing plate and the upper and lower bearings around the mounting post thereby enabling the tablet arm to pivot from a right side of the chair to a left side of the chair.

14. The chair of claim 13 wherein the mounting arrangement prevents the tablet arm from pivoting more than a predetermined amount relative to the chair support structure.

15. The chair of claim 13 wherein the writing tablet is pivotally coupled to the tablet arm such that the writing tablet can pivot toward and away from the occupant.

* * * * *